United States Patent [19]

Howe et al.

[11] 3,949,217

[45] Apr. 6, 1976

[54] ELECTRIC BULB HOLDER

[75] Inventors: John Arthur Howe, Tollerton; Harvey Albert Mole, Heanor, both of England

[73] Assignee: TRW Inc., Cleveland, Ohio

[22] Filed: Aug. 2, 1974

[21] Appl. No.: 494,134

[52] U.S. Cl. ..... 240/52.1; 339/127 R

[51] Int. Cl.[2] ..... F21V 21/08

[58] Field of Search..... 240/2 R, 8.16, 8.2, 8.3, 240/52 R, 52.1, 153, 57; 339/91 L, 119 L, 127 R, 176 L

[56] References Cited

UNITED STATES PATENTS

| | | | |
|---|---|---|---|
| 2,238,728 | 4/1941 | Hadley et al | 240/52.1 X |
| 2,905,809 | 9/1959 | Pascucci | 240/153 X |
| 3,047,829 | 7/1962 | Mouat | 240/8.3 X |
| 3,319,909 | 5/1967 | Goslin | 240/8.16 X |
| 3,511,982 | 5/1970 | Salter | 240/8.16 |

FOREIGN PATENTS OR APPLICATIONS

| | | | |
|---|---|---|---|
| 713,700 | 8/1954 | United Kingdom | 240/153 |

*Primary Examiner*—Fred L. Braun
*Attorney, Agent, or Firm*—James R. O'Connor

[57] ABSTRACT

An electric bulb holder for supporting a bulb in an apertured panel includes a moulded plastic housing, a contact strip for effecting electrical contact with a bulb seated in the housing and a sheet metal stamping mounted on the housing. The housing includes smaller and larger diameter parts joined by a transverse wall, a locating rim for guiding the housing into the panel aperture and a skirt for effecting a seal about the panel aperture. The sheet metal stamping includes a retaining ring which is fixedly seated on the transverse wall of the housing, a plurality of bayonet-type bulb retaining tangs extending from the ring into the smaller diameter part of the housing, a blade-type electrical terminal extending through a slot in the transverse wall of the housing and lying alongside the outer wall of the smaller diameter part of the housing, and a plurality of mounting wings having leading end parts for retaining the bulb holder in assembly with the panel responsive to axial insertion of the locating rim into the panel aperture and rotation of the holder relative to the panel. The mounting wings also include trailing end parts cooperable with edges of the panel aperture to inhibit accidental counterrotation of the holder relative to the panel.

9 Claims, 7 Drawing Figures

ELECTRIC BULB HOLDER

This invention relates to an electric bulb holder, and particularly to a bulb holder for holding a low voltage bulb such as is used in a car rear light assembly or fitting.

On present day cars rear light fittings project inwardly into the rear luggage compartment, so that they may be subjected when in use to interference by luggage disposed or being placed in that compartment. The further these fittings project into the luggage compartment, the more likely is it that they will suffer interference or damage.

Futhermore, such rear light fittings now incorporate a plurality of bulbs which serve different and important functions, so that accidental damage or displacement of a bulb could have serious consequences. Thus these bulbs have to be held securely in position, and yet be readily removable for replacement purposes.

It is also desirable that such rear light fittings be dust and water tight, so that precautions must be taken to ensure that sealing arrangements are not impaired when replacing a bulb.

some present day bulb holders for use in rear light fittings have metal spring fixing arrangements which enable the holder to snap axially into and out of engagement in a mounting aperture in a fitting. Unfortunately such bulb holders are readily snapped out of engagement if they are struck sideways by a piece of lug gage. Furthermore, such bulb holders have electrical connections which project from the rear end of the bulb holder and which thus increase the risk of interference by luggage.

According to the present invention an electric bulb holder for supporting an electric bulb in an automobile light fitting includes a cup-shaped housing having parts for receiving, holding and making electrical contact with the bulb, and parts for removably engaging and supporting the housing in an aperture of an apertured support panel of the light fitting, and is characterised in that: the housing is provided at its open end with:

a. an annular location rim for guiding and locating that end of the housing in the said aperture,
b. a plurality of bayonet-action wings spaced apart around the outside of the location rim for engagement with corresponding notches of the aperture, and
c. a sealing skirt extending radially outwards from the housing to engage a sealing part of the apertured panel which extends continuously around and is spaced radially outwards of the notched aperture, the sealing skirt also extending radially outwards of the wings, and the wings having leading-end parts which, on rotation of the housing in the aperture to secure it therein and with the location rim guided in the aperture, react with the edges of the notches at their leading-ends and so draw the housing axially further into engagement with the apertured panel and simultaneously engage the sealing skirt with the panel in a substantially water-tight manner.

According to a preferred embodiment of the invention, the wings have resilient trailing-end parts which, on rotation of the housing in the apertured panel, engage with and are temporarily deflected from their unstressed position by the trailing edges of the notches, until eventually a locked position is reached in which the trailing-end parts are substantially disengaged again from the trailing edges. subsequent rotation of the housing in the reverse sense to disengage the housing from the apertured panel then being possible only upon the application of a reverse torque sufficient to cause the trailing-end parts to be resiliently deflected from their unstressed position by the said trailing edges.

The housing is formed as a one-piece moulding of a synthetic plastic material and has fixed therein, near the open end thereof, a metal ring which has extending therefrom, towards the closed end of the housing, axial tangs having recesses at the free ends for receiving and engaging transverse metal studs provided on a metal cap of a bulb for the purpose of enabling the bulb to be secured in the housing by a bayonet-action, the metal ring also having extending therefrom radial arms which carry the said bayonet action fixing clips.

The housing is stepped in diameter near its open end, the metal ring is fixed in the larger diameter part of the housing, the said axial tangs extend within the smaller diameter part of the housing towards the closed end thereof; and the radial arms pass through slots in the location rim.

In a preferred arrangement electrical connection members for making connection with a bulb secured in the housing extend through a transverse wall connecting the smaller and larger diameter parts of the housing and extend alongside the outside wall of the smaller diameter part of the housing. The metal ring has a further axial limb which extends through the said transverse wall to provide one of said electrical connection members lying alongside the smaller diameter part of the housing.

In a modified embodiment the sealing skirt carries a resilient sealing ring disposed in a recess formed in the skirt.

A bulb holder according to the invention for engaging in a rear light fitting of a motor car will now be described by way of example and with reference to the accompanying drawings in which.

Figure 1:
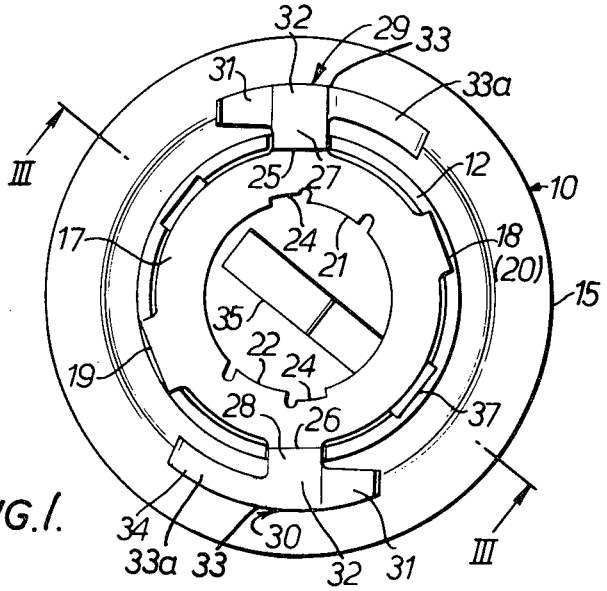
FIG. 1 shows a plan view of the holder.
Figure 2:
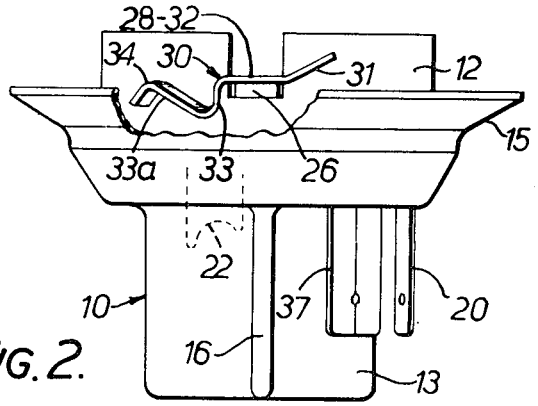
FIG. 2 shows a side view of the holder.
Figure 3:
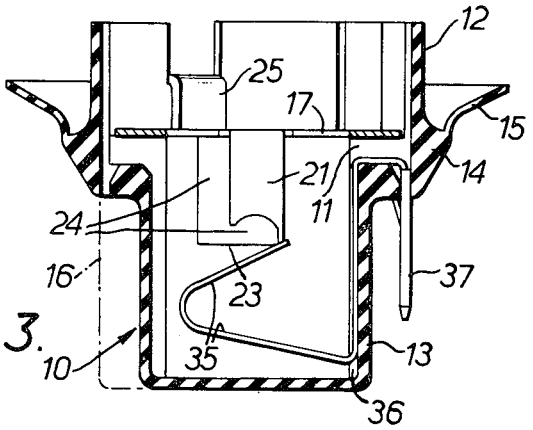
FIG. 3 shows a vertical cross-section taken on the line III—III of FIG. 1.

Referring now to the FIGS. 1 to 3, the bulb holder there shown comprises a one piece moulding of a synthetic plastic material, for example, nylon, in which are carried various metal parts. The moulding comprises a generally cylindrical cup-shaped housing 10 which is stepped from a smaller diameter at its lower, closed end to a larger diameter near its upper open end. A transverse annular wall 11 separates the upper, larger diameter housing part which includes locating rim 12 from the lower, smaller diameter housing part 13. The lower part of the wall defining the said upper housing part is thickened at 14 and from this thickened wall there rises upwardly and outwardly a resilient sealing skirt 15. Axially-extending ribs 16, shown in FIG. 2 and also in FIG. 3 in chain dotted form out of their true positions, are formed externally on opposite sides of the lower housing part 13.

Seated upon the transverse annular wall 11 is a sheet metal ring 17 having the shape shown in the figures. The ring is secured in position by two downwardly-extending fixing lugs 18, 19, which are carried, diametrically opposite one another, at the outer periphery of the ring, and which engage tightly in vertical slots formed in the transverse wall. One of these fixing lugs extends through the transverse wall to provide a connection member 20 onto which an electrical connector may be pushed whereby to connect the ring with an external circuit. The ring also carries at its inner periphery, at diametrically opposite positions, two downwardly-extending tangs 21, 22 which lie in and partly fill axial channels 23 formed in the inner cylindrical surface of the lower part of the housing. The unfilled part of one of those channels is indicated at 24 in FIG. 3. The lower end of each such tang is shaped in the manner best shown in FIG. 3 to receive and locate a transverse stud carried on the side of a bulb to enable it to be secured in the holder by a bayonet type action.

The ring 17 also carries at its outer periphery, at diametrically opposite positions, two upstanding members 25, 26, which have at their upper ends radially-projecting horizontal arms 27, 28. These arms carry similar wings 29, 30 which extend therefrom in circumferential directions. Each such wing comprises a leading-end part including a wedge part 31 which rises circumferentially at an angle to a central part 32 which is disposed in a plane lying substantially normal to the longitudinal axis of the housing and which is secured on the associated radial part 27, 28, and a trailing-end part including a stop 33 which falls from the said central part and a wedge part 33*a* which rises from the stop to a crest 34 before falling again, as is best seen in the FIG 2.

A resilient contact strip 35 for making contact with a central terminal at the end of a bulb cap and having the shape best seen in FIG. 3, is carried in an axially extending recess 36 formed in the wall of the lower part of the housing. The contact strip is bent over on itself at its upper extremity and terminates in a downwardly extending connection member 37 which passes axially through and is secured in an axial slot formed in transverse wall 11.

In use a bulb is inserted into the lower, smaller diameter part of the housing so that its end terminal contacts and depresses the contact strip 35, and so that its transverse fixing studs, which project from the lower part of the bulb cap, ride down the axial slots 24 in the moulding, and then enter under the recessed ends of the dependent tangs 21, 22 on rotation of the bulb to secure it in position.

Figure 4:
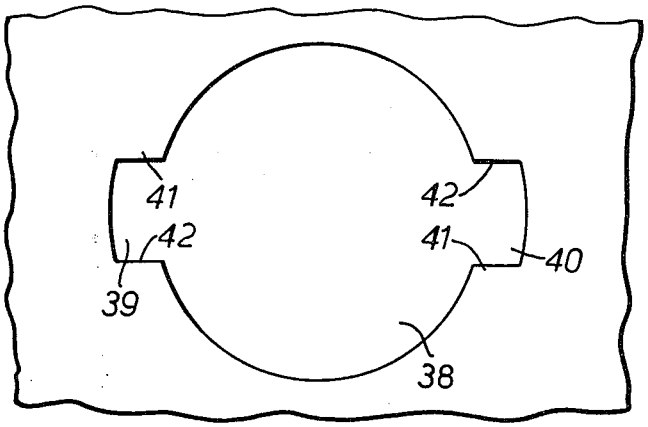
FIG. 4 shows a plan view of part of a panel having an aperture in which the bulb holder is intended to be secured.

The bulbholder, complete with bulb is now presented to an aperture 38 (see FIG. 4) formed in the panel of a car rear light fitting, with the leading-end wedge parts 31 of the two wings 29, 30 in alignment with two notches 39, 40 formed in the circular periphery of the aperture, and with the locating ring 12 in alignment with the aperture. Axial movement of the bulb holder into the aperture causes the leading-end wedge parts 31 of the wings to enter the notches 39, 40 and the lip of the sealing skirt 15 to engage an annular sealing surface on the rear part of the panel.

The bulb holder is now rotated clockwise, and this movement causes the inclined lower surface of the leading-end wedge part 31 of each wing to ride up over the adjacent leading-end edge 41 of the associated notch, with the result that the bulbholder is drawn bodily further into the aperture in the panel. This axial movement of the bulb holder causes the crest 34 of the trailing-end wedge part 33a of each wing to be depressed relative to the adjacent central part of the wing, until on rotation of the bulbholder still further to its final position, i.e., when stops 33 engage the edges 41 of the notches, each such crest moves into the associated notch 39, 40 in the panel and there resiles to its normal unstressed position. In this position each crest projects axially into the associated notch and so inhibits unintentional rotation of the bulb holder in the reverse direction.

To release the bulbholder from the panel a substantial reverse torque in an anti-clockwise direction has to be applied to the bulbholder whereby to cause the appropriate trailing-end edges 42 of the notches to depress the trailing-end wedge parts 33*a* of the two wings and so permit anti-clockwise movement of the bulbholder.

The external ribs 16 readily enable the requisite torques to be applied to the bulbholder whereby to secure and release it.

Figure 5:
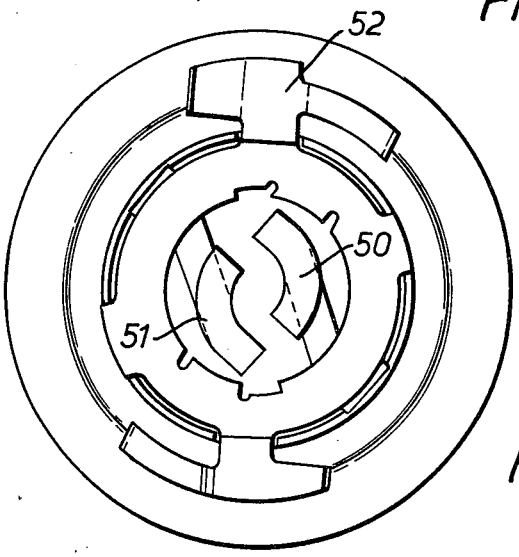
FIG. 5 shows a plan view of the bulb holder when modified to receive a two pole bulb.
Figure 6:
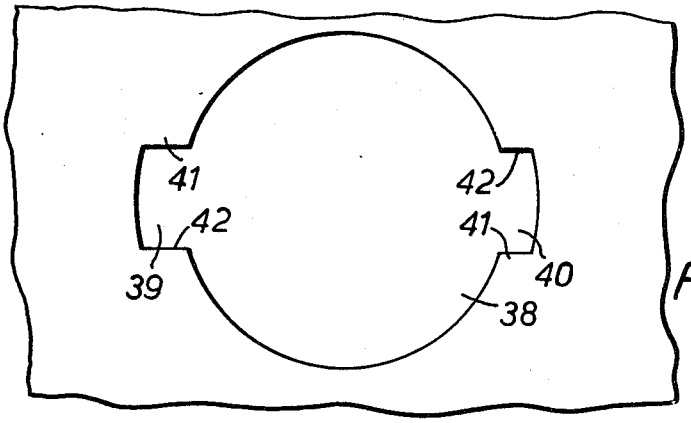
FIG. 6 shows a plan view similar to that of FIG. 4, showing an aperture suited to the modified bulb holder of FIG. 5.

In the modified bulbholder shown in the FIGS. 5 and 6, the single contact strip 35 of the bulb holder just described is replaced by two oppositely disposed contact strips 50, 51 as shown, and one of the wings 52 for securing the bulbholder in position in a fitting has its leading-end part 52 enlarged, so that the bulbholder can be inserted only in one angular position in a panel having an aperture as shown in FIG. 6. This aperture has notches of different radial extent so that the two pole bulb holder must be properly presented to the aperture so as to gain access to the aperture.

Figure 7:
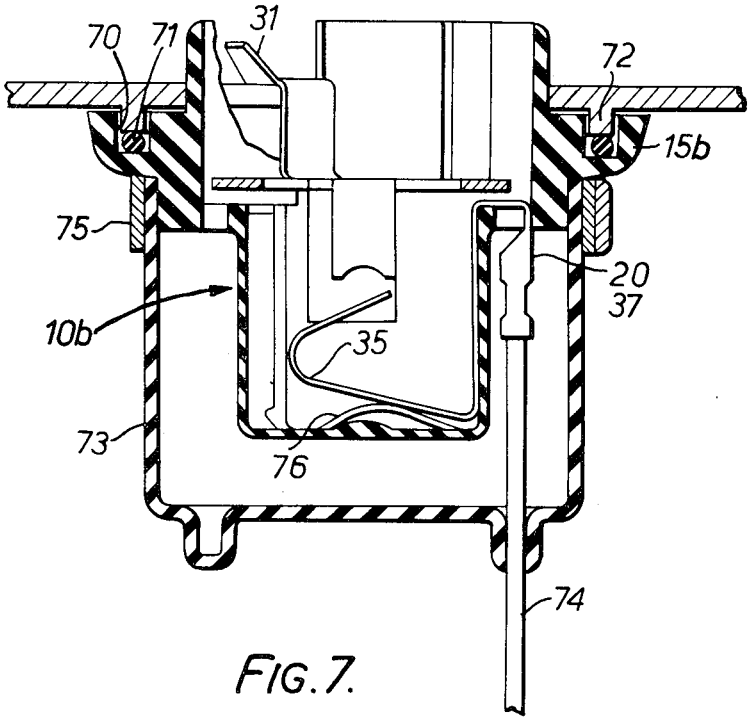
FIG. 7 shows a vertical cross-section, similar to that of FIG. 3, of a modified version of the bulb holder shown in the FIGS. 1 to 3.

In the modified bulb holder shown in the FIG. 7, the principal difference lies in the shaping of the sealing skirt 15*b* which encircles the larger diameter part of the housing 10*b* . This modified form of sealing skirt is made less resilient at its lip, and instead has formed therein an annular recess 70 of suitable radial cross section, in which recess is disposed an O-ring 71 of suitable resilient sealing material. The recess is arranged to receive a projecting annular sealing area 72 formed integrally on the outer side of the apertured panel in which the bulb holder is intended to fit. This annular sealing area 72 is pressed firmly against the O-ring 71 in recess 70 by the axial movement of the bulb holder into the apertured panel which results from the drawing of the housing into the panel responsive to its rotation as aforesaid.

This improved form of sealing means is less susceptible to damage (e.g. of the delicate lip of the skirt 15), and hence is more reliable in action, though it may necessitate the provision of a projecting annular sealing area 72 on the apertured panel.

A weatherproof rubber or plastic shroud 73 may be fitted over the part of the bulb holder which projects from the apertured plate of the light fitting, to protect the electrical connections made between the connection members 20, 37 and the associated external electrical wiring 74. Such a shroud may be conveniently fitted around the larger diameter part of the moulding at the rear of the sealing skirt 15*b* and be held in position by a simple form of hose clip 75.

A carbon steel back-up spring 76 may be fitted in the closed end of the housing 10*b* between the wall of the housing and the electrical contact member 35, so as to provide a more reliable electrical connection between that contact member and a central pole of an electric bulb inserted in the holder.

We claim:

1. An electric bulb holder for supporting a bulb in an apertured panel comprising: a generally cylindriform, cup-shaped housing having a first, closed end part, and a second, open end part, the diameter of said second part being greater than the diameter of said first part, and a transverse wall disposed at the junction of said first and second parts, said second part including a rim for locating said housing in the panel aperture and a sealing skirt disposed radially outwardly of said rim for engaging one side of the panel; electrical contact means for a bulb disposed in said first part of said housing; and a one-piece sheet metal stamping secured to said housing, said stamping including a retaining ring seated on said transverse wall, lamp retaining tangs extending from said ring into said first part of said housing, and a plurality of holder mounting wings joined to said ring and circumferentially spaced about the outer periphery of said locating rim, said wings including a leading end part for engaging the other side of the panel responsive to axial insertion of said location rim into the panel aperture and rotation of the holder relative to the panel and a trailing end part cooperable with the edges of the panel aperture to inhibit accidental counterrotation of the holder relative to the panel.

2. An electric bulb holder according to claim 1, wherein said cup-shaped housing is a one-piece moulding of synthetic plastic material.

3. An electric bulb holder according to claim 1 wherein said locating rim has a plurality of axially extending slots formed there-through and said holder mounting wings are connected to said retaining ring by radial arms which extend through said slots.

4. An electric bulb holder according to claim 1 wherein a plurality of electrical connection members for making connection with a bulb secured in the holder pass through said transverse wall of said housing and extend alongside the outside wall of said first part of said housing, at least one of said connection members being integrally joined to said retaining ring.

5. An electric bulb holder according to claim 4 wherein at least one of said connection members is integrally joined to said electrical contact means.

6. An electric bulb holder according to claim 1 wherein said sealing skirt has a resilient sealing ring disposed in a recess formed in said skirt.

7. An electric bulb holder according to claim 1 wherein said leading end part of each of said holder mounting wings includes a central part disposed in a plane substantially normal to the longitudinal axis of said housing and a leading end wedge part extending circumferentially from and rising angularly from one end of said central part, and said trailing end part includes a rotation limiting stop descending form the other end of said central part and a trailing end wedge part extending circumferentially from said stop, in a direction opposite said leading end wedge part, to a downwardly bent termination at its free end.

8. An installation comprising: a mounting panel having an aperture formed therethrough and a plurality of radially extending notches spaced about and communicating with said aperture, each of said notches having leading and trailing end edges, and an electric bulb holder including a housing having an open end and a closed end, a locating rim disposed adjacent said open end extending through said panel aperture, a sealing skirt seated against one side of said panel beyond the outer periphery of said notches, and a plurality of mounting wings connected to said housing and disposed about the outer periphery of said locating rim each of said mounting wings having resilient leading end parts extending through said notches and over the leading end edges thereof and overlying the side of said panel opposite that against which said skirt is seated and resilient trailing end parts disposed within said notches and having free ends located opposite said trailing end edges of said notches to inhibit accidental rotation of said bulb holder relative to said panel, said trailing end parts being automatically deflectable out of said notches responsive to deliberate rotation of said holder in a holder-releasing direction relative to said panel to effect intentional removal of said holder from said panel.

9. In a removable mounting construction for securing an electric bulb holder to a supporting panel having an aperture therein including a generally circular central portion and a plurality of spaced notches extending radially outwardly from and communicating with said central portion, each of said notches having leading and trailing end edges, an annular rim on said bulb holder for guiding and locating the holder in the central portion of the aperture and a plurality of resilient mounting wings fixed to said holder and disposed about the outer periphery of said annular rim, each of said wings having a leading end part including an upwardly bent wedge part and a trailing end part including a downwardly bent wedge part, each of said end parts having a length substantially equal to the length of said mounting aperture notches, whereby upon axial insertion of said holder rim into said central portion of said mounting aperture, said leading end parts, when properly aligned, will pass through said notches and over the leading end edges thereof and upon subsequent rotation of said holder, said upwardly bent wedge parts will cammingly index said leading end parts into engagement with said panel and said trailing end parts will resile into said notches so that said downwardly bent wedge parts will locate opposite the trailing end edges of said notches and inhibit counterrotation of said holder relative to the mounting panel.

* * * * *